US005345803A

United States Patent [19]

Cutter

[11] Patent Number: 5,345,803

[45] Date of Patent: Sep. 13, 1994

[54] ADJUSTABLE TUBE BENDING METHOD AND APPARATUS

[75] Inventor: Everett A. Cutter, Bow, N.H.

[73] Assignee: General Electric Company, Cincinnati, Ohio

[21] Appl. No.: 113,124

[22] Filed: Aug. 30, 1993

[51] Int. Cl.[5] ..... B21D 7/00

[52] U.S. Cl. ..... 72/157; 72/149

[58] Field of Search ..... 72/157, 149

[56] References Cited

U.S. PATENT DOCUMENTS

| | | | |
|---|---|---|---|
| 1,542,355 | 6/1925 | Barker | 72/157 |
| 1,773,430 | 8/1930 | McDonnell | 72/157 |
| 1,849,181 | 3/1932 | Francis | 72/157 |
| 2,275,619 | 3/1942 | Enberg et al. | 72/157 |
| 3,276,236 | 10/1966 | McDowell | 72/157 |
| 3,821,525 | 6/1974 | Eaton et al. | 235/151.1 |
| 4,142,394 | 3/1979 | Damman | 72/220 |
| 4,232,813 | 11/1980 | Eaton | 228/147 |
| 4,355,525 | 10/1982 | Carson | 72/149 |
| 4,546,632 | 10/1985 | Van Den Kieboom et al. | 72/158 |
| 4,630,459 | 12/1986 | Elliott | 12/307 |
| 4,864,509 | 9/1989 | Somerville et al. | 364/476 |
| 4,947,666 | 8/1990 | Hametner et al. | 72/37 |
| 5,125,252 | 6/1992 | Ayres et al. | 72/157 |
| 5,187,963 | 2/1993 | Sutton, Jr. et al. | 72/157 |
| 5,214,950 | 6/1993 | Grobbenhaar | 72/150 |
| 5,226,305 | 7/1993 | Adleman et al. | 72/157 |

*Primary Examiner*—David Jones

*Attorney, Agent, or Firm*—Jerome C. Squillaro; Nathan D. Herkamp; C. W. Stamos

[57] ABSTRACT

Disclosed is an apparatus for producing smooth, continuous arcuate contour bends in tubes used, for example, in the manufacture of fuel manifolds for gas turbine engines. A flexible die cavity circumscribing an arbor member with an integral adjustment feature are utilized to provide means for modifying the radius of curvature of the forming die cavity to compensate for variable tube spring back characteristics. A first embodiment provides for infinite adjustment of radius of curvature within range limits, while an alternate embodiment provides for incremental adjustment. Means are also provided to lock the adjustment feature once the desired radius of curvature has been achieved.

10 Claims, 4 Drawing Sheets

ADJUSTABLE TUBE BENDING METHOD AND APPARATUS

TECHNICAL FIELD

The present invention relates generally to the manufacture of contoured tubing and more specifically to an improved method and apparatus for generating precision arcuate contour bends in a plurality of straight segment tubes exhibiting differing mechanical properties.

BACKGROUND INFORMATION

External configuration hardware of conventional gas turbine engines used to power aircraft and marine systems or used as industrial power generation sources generally comprises a plurality of tubes which provide fuel, oil and pressurized air to various engine components and subsystems. Due to generally restrictive installation volume routing requirements, the tubes are typically intricately convoluted, comprising a plurality of precise bends to provide proper clamping and end fitting locations. The materials utilized and processes employed to manufacture the hardware are selected to ensure a high degree of operational reliability. Further, tube contour and fitting orientation is tightly controlled as assembly stresses induced in the tube during installation due to improper contour can severely reduce tube life, oftentimes with dire consequences. For example, failure of a pressurized oil system tube during engine operation could result in loss of oil supply to the rotor bearings causing significant primary damage to the engine. Failure of a fuel system component, such as the main combustor fuel manifold tube, could result in degraded engine performance, flameout and possibly extensive secondary damage should a fire be initiated. All safety and performance critical tubes are therefore designed to meet rigorous operational requirements such as pressure, vibration and thermally induced stress cycling. Additionally, special care must be taken during manufacture, storage, transport and assembly to prevent nicks, kinks or other detrimental features which violate the integrity of the tube and may lead to premature failure.

An example of a particularly important system in a gas turbine engine is the main fuel distribution system. The system is designed for light weight, ease of maintenance and high reliability. By minimizing the number of separate components which must be brazed, welded or otherwise attached in a leakproof assembly, overall system reliability may be maximized. In a preferred system, two semicircular tubes comprise a main fuel manifold which circumscribes the engine proximate the combustor. The tubes are Joined together at the engine split lines with pressurized fuel being provided through a large inlet fitting. A plurality of equiangularly spaced T-fittings and short pigtail tubes are arranged around the manifold to provide fuel to respective fuel nozzles.

During manufacture, a straight section of tubing of appropriate diameter is bent in a forming die to create a smooth, continuous arcuate contour. A plurality of apertures are produced in appropriate locations, one per T-fitting, and the fittings are slid over the tube and brazed in place. To ensure high quality braze Joints and a reliable assembly, the gap between the tube and each fitting must be tightly controlled; therefore, the through hole in each fitting is of arcuate contour to match the arcuate contour of the manifold tube. Clearance for manufacturing tolerance, assembly and braze gap is nominally only one to three mils for one half inch diameter tubing. As can be readily appreciated, the straight tube sections must be of very uniform diameter and the bending process to form the arcuate contour must be tightly controlled to achieve a leakproof assembly. Local surface discontinuities such as ovalization, kinking, flattening or wrinkling of the tube prevent assembly of the fittings. Further, contour discontinuities, such as straight sections of tubing Joined by small radius bends, similarly prevent assembly.

Conventional manufacturing schemes rely on a rigid bending die having a constant radius of curvature die cavity face on an external circumference thereof. As is well known in the art, to produce a bend of a desired radius of curvature in an unrestrained tube, the tube must initially be bent to conform to a smaller radius of curvature to compensate for elastic springback of the tube material. The amount of springback in a tube varies depending on a plethora of geometric and metallurgical characteristics and oftentimes, while the die may produce an acceptable contour for a first tube, it may not for the next. Small variations in wall thickness or hardness due to minor differences in heat treat, while producing generally acceptable tubing which meets industry specification requirements, cause unacceptable fallout during tube forming. Tubes which fail to meet the contour requirement, for example a sixty rail volume envelope for a one half inch tube bent in a semicircle having a nominal radius of fifteen inches, must be manually reworked. Tubes which cannot be reworked to meet the volume contour requirement or suffer ovalization or other distress during manual adjustment cannot be utilized and are scrapped.

Prior attempts to solve tube forming variability in a systematic manner have proven to be cost prohibitive or of limited benefit. For example, instituting unique, highly restrictive tubing material processing and geometry specifications would be very costly to develop and implement. Alternatively, significantly relaxing the contour tolerance requirement would result in premature failure of tubing with excessive installed assembly stresses. Another alternative, producing a series of incrementally sized bending dies for each diameter, radius of curvature and material tube is costly, as well and an unacceptable option in a production environment. An adjustable die employing an expander concept with a plurality of radially adjustable wedge segments would produce unacceptable, nonuniform bends as discussed hereinbefore.

SUMMARY OF THE INVENTION

The innovative tube bending apparatus is comprised of a rigid arbor member circumscribed by a resilient arcuate annular die cavity body. Integral adjustment means provide the facility to uniformly modify the radius of curvature of the die cavity by changing the radial support location of the die cavity by the arbor. In a preferred embodiment, the interface between the arbor and the die cavity includes mating frustoconical surfaces such that by changing the relative registration of the mating surfaces, the radius of curvature of the die cavity is changed. This apparatus provides an adjustment means and result die cavity radius of curvature which are infinitely adjustable within their respective ranges.

In an alternate embodiment, the resilient die cavity and rigid arbor member have generally flat mating contours. A continuous band is disposed therebetween in one or more trap layers to incrementally modify the radius of curvature of the die cavity by changing the radial dimension of the support surface of the die cavity. On both embodiments. Means are provided to clamp a tube to be bent and draw the tube through a tube forming zone formed by the resilient die cavity body and a proximate arcuate die cavity follower member. The clamp and follower member may be made adjustable to provide proper tube alignment throughout the resilient die cavity adjustment range. Die cavity adjustment actuation and locking means are also disclosed.

BRIEF DESCRIPTION OF THE DRAWINGS

The novel features believed characteristic of the invention are set forth and differentiated in the claims. The invention, in accordance with preferred and exemplary embodiments, together with further objects and advantages thereof is more particularly described in the following detailed description taken in conjunction with the accompanying drawings in which:

MODE(S) FOR CARRYING OUT THE INVENTION

Figure 1:
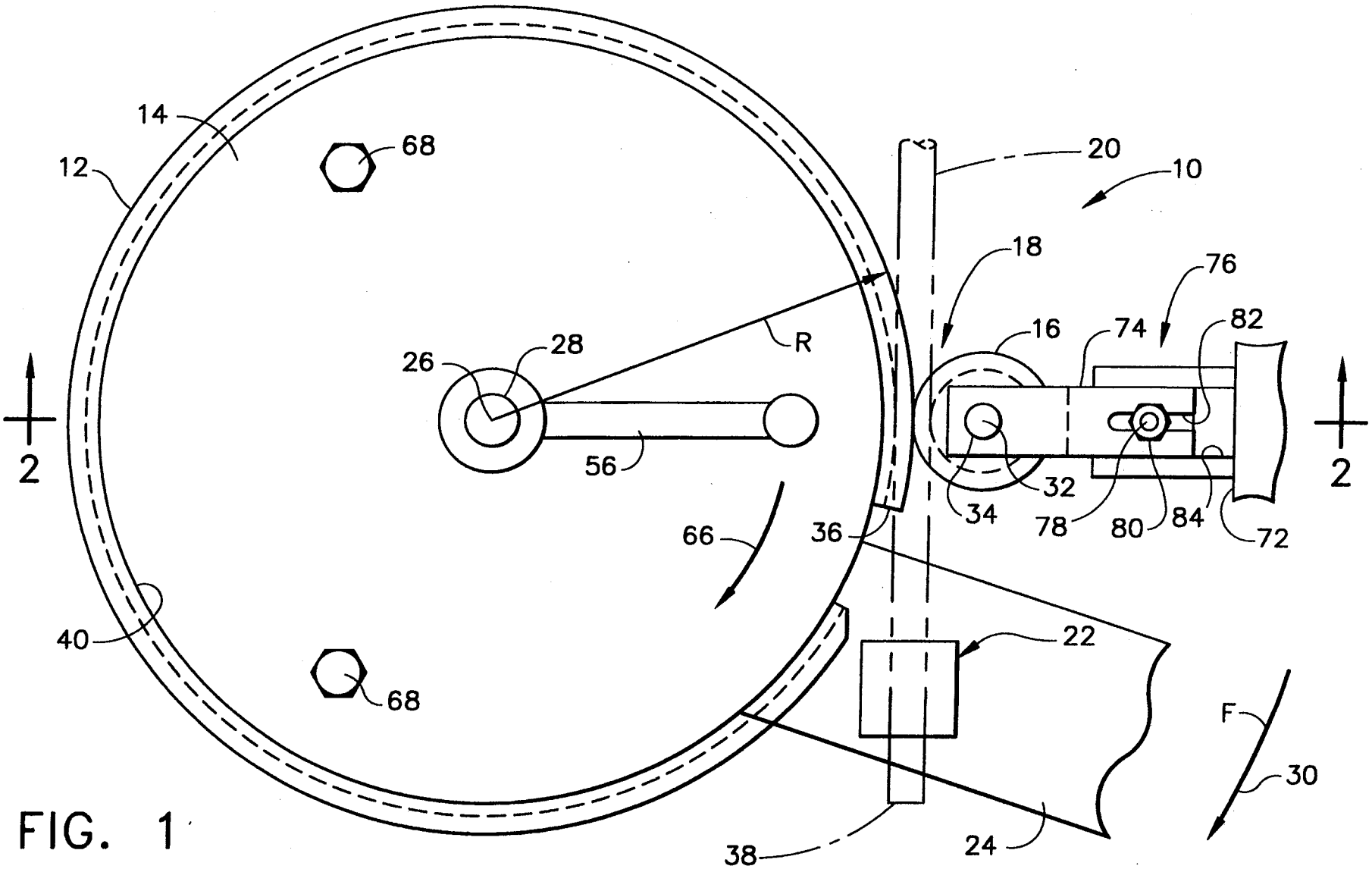
FIG. 1 is a schematic, plan view of a tube bending apparatus in accordance with an exemplary embodiment of the present invention.

Shown in FIG. 1 is a schematic plan view of an exemplary embodiment of an adjustable tube bending apparatus 10 in accordance with the present invention. The apparatus 10 comprises an arcuate die cavity body 12 circumscribing at least a portion of a rigid arbor member 14. Proximate the die cavity 12 is a second arcuate die cavity follower 16 which is coplanar with the first die cavity 12. Created therebetween at a common tangency is a tube forming zone, shown generally at 18. A tube segment 20, shown here in phantom, passes through the forming zone 18 and is fixedly restrained in a conventional tube clamping arrangement 22. The clamp 22 is radially and axially aligned with the forming zone 18 prior to initiation of the forming or bending operation so that the tube 20 may be readily loaded in the apparatus 10. As shown in this depiction, the clamp 22 is disposed on a radially extending arm 24 which is configured to rotate with arbor 14 and first die cavity 12 about a first axis of rotation 26 on a first spindle 28. In practice, the clamp 22 and arm 24 are initially positioned proximate the forming zone 18 near a first end 36 of the die cavity 12 so that the tube 20 is fully supported during the forming operation. The clamp 22 and arm 24 are shown here circumferentially displaced to facilitate depiction.

In order to form a planar arcuate bend, tube 20 is loaded in the apparatus 10 as shown and clamped in clamp 22 a short distance from a first proximal tube end 38. Any manner of conventional clamping is acceptable, such as a pair of clamp faces configured to accept the tube and actuated by a quick release toggle assembly (not shown), as long as the tube 20 is reliably held. For purpose of illustration, a straight tube segment 20 is depicted; however, as can be readily appreciated, various clamping arrangements can be utilized to grasp a preconvoluted tube or a tube having a nonuniform feature such as a brazed end fitting. For the particular application of the semicircular fuel manifold tube mentioned hereinbefore, a continuous 180° arcuate bend is required, with straight, tangentially extending end portions, a configuration readily produced in this apparatus 10.

Having loaded and clamped the tube 20 in place, a force F is applied to the radial arm 24 in the plane of the dies 12, 16, as shown by arrow 30 causing the arbor 14 to rotate in a clockwise direction in this depiction. First die cavity 12 is fixedly restrained at end 38 for rotation with arbor 14 swill be discussed in more detail hereinbelow. As tube 20 is drawn through forming zone 18, the die cavity follower 16 maintains a radial load on the tube 20, providing support to deform the tube 20, causing the tube 20 to be wrapped around first die cavity 12. The loading on both die cavities 12, 16 is generally compressive as the follower 16 is configured to rotate about a second axis of rotation 32 on a second spindle 34. Arm 24 is rotated through a continuous arc sufficient to produce the desired arc sweep of the tube 20. Any of a variety of conventional indicators such as degree markings, pointers or pins and stops may be incorporated on a rim portion 40 of the arbor 14 to denote arbor travel or degree of bend.

Once the tube 20 has been bent to the desired extent, the arm 24 is rotated in the opposite direction. Due to elastic springback, the tube 20 pulls radially away from the die 12 after passing through the forming zone 18 and may be readily released from the clamp 22 and removed from the apparatus 10. The tube 20 is conventionally inspected with a contour gauge or other means to ascertain whether the arcuate contour is within allowable limits. In the event the tube 20 exhibits an unacceptable contour, whether too large or too small a radius of curvature, the instant invention affords freedom of adjustment of the radius of curvature R of the first die cavity 12 to produce an acceptable contour.

Figure 2:
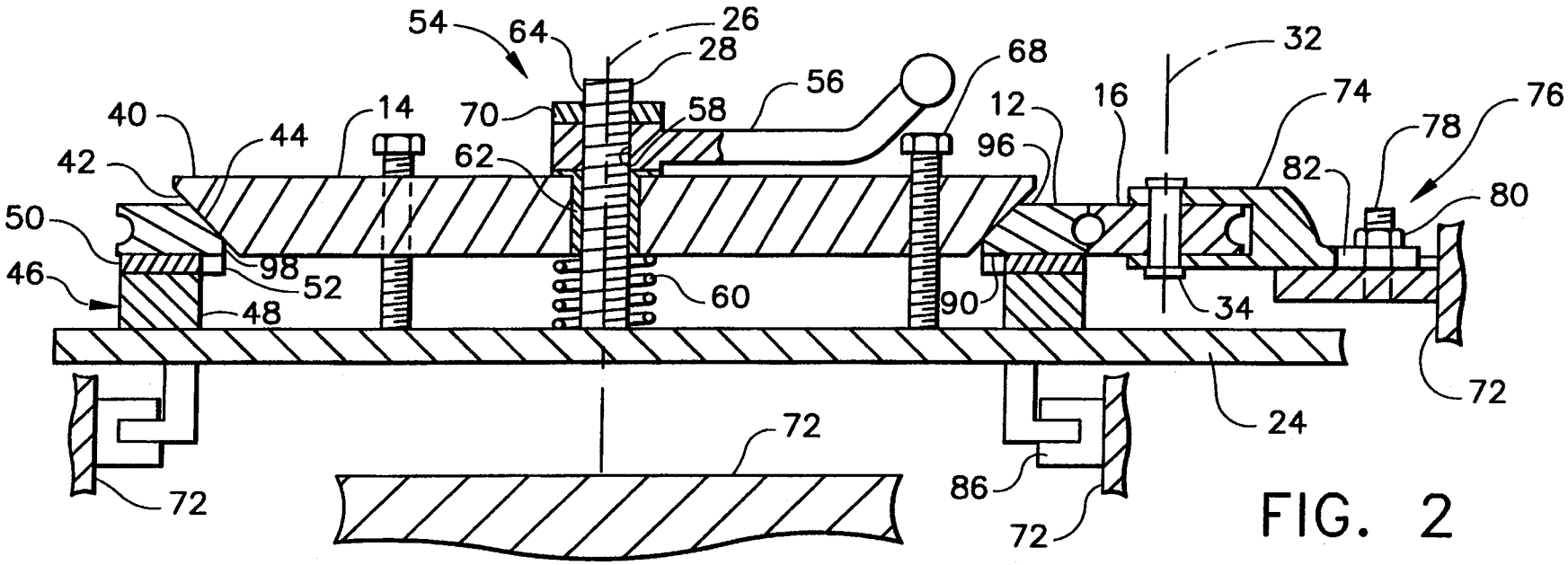
FIG. 2 is a schematic longitudinal sectional view of the invention depicted in FIG. 1 taken along line 2—2.

The radius of curvature adjustment feature 54 may be more readily understood by referring now to FIG. 2. Arbor 14 has a generally inwardly tapering, inverted frustoconical contour 42 about the rim 40. First die cavity 12 is comprised of a resilient material, such as tetrafluoroethylene (TFE) or nylon, and configured as an annular member having an internal, mating frustoconical contour 44. The die cavity 12 rests on a support structure 46 comprised of a spacer ring 48 and a toothed ring 50 having a plurality of radially inwardly extending protrusions 52 configured to support the die cavity 12 throughout the adjustment range of the arbor 14. In a first exemplary embodiment, the adjustment feature 54 comprises a first spindle 28 having a threaded portion 64 in cooperation with a radially extending handle 56 having a threaded bore 68. A compression spring 60 compliantly supports the arbor 14 which rides on a close fitting bushing 62 disposed around the spindle 28.

Referring also now to FIG. 1, rotation of handle 56 with respect to arbor 14 causes axial translation of the arbor 14 along spindle 28. This translation results in a change in registration between respective frustoconical contours 42, 44 of the arbor 14 and die 12, as the die 12 is axially supported by the toothed ring 50. For a conventional right-handed spindle threaded portion 64, rotation of handle 56 in the clockwise direction 66 forces the arbor 14 down, as shown in FIG. 2, compressing spring 60 and forcing the die cavity 12 radially outwardly increasing the effective radius of curvature R. Similarly, counterclockwise rotation of the handle 56 allows the spring 60 to raise the arbor 14, allowing the die cavity 12 to contract to a smaller effective radius R. Friction in the adjustment feature 54 in cooperation with the axial load induced by the spring 60 has been found to be sufficient to retain a fixed registration between the arbor 14 and die 12 during bending operations. Further, the spindle 28 is of sufficient diameter to provide adequate support to maintain the arbor 14 coplanar with die 12 and support structure 46. For applications requiring large bending forces F where there is concern that arbor 14 and die 12 coplanarity may be affected, a Jam nut 70 could be added to the spindle 28 and locked against the threaded bore 58 of handle 56. Further, three jacking screws 68 could be utilized in the arbor 14 in a triangular pattern to provide additional stability. Alternatively, multiple adjustment means 54 could be employed in a triangular or other pattern.

For simplicity, the arbor 14, die 12 support structure 46 and arm 24 are depicted as rotating about axis 26 with respect to ground frame 72 on annular bearing 86. Also attached to the frame 72 is the housing 74 for the die cavity follower 16. Radial adjustment means 76 are provided between the housing 74 and the frame 72 to maintain tangency between the die body 12 and the die follower 16 throughout the adjustment range of the arbor 14. For example, when the radius of curvature R of the die body 12 is increased due to axial translation of the arbor 14 downward, as depicted in FIG. 2, the housing 74 must be shifted radially outwardly, or to the right. The adjustment means 76 can be any of a variety of conventional configurations such as a slide 84, having a centrally located stud 78 with a lock nut 80 disposed through a housing slot 82. The radial location of the housing 74 should be fully adjustable and robustly retained in the desired location once locked in place. A similar radial adjustment means is suitable for use with the clamping arrangement 22 mounted on the arm 24, as the clamp 22 too must accommodate changes in radial location of the die cavity 12 during adjustment as discussed hereinbefore.

Figure 3:
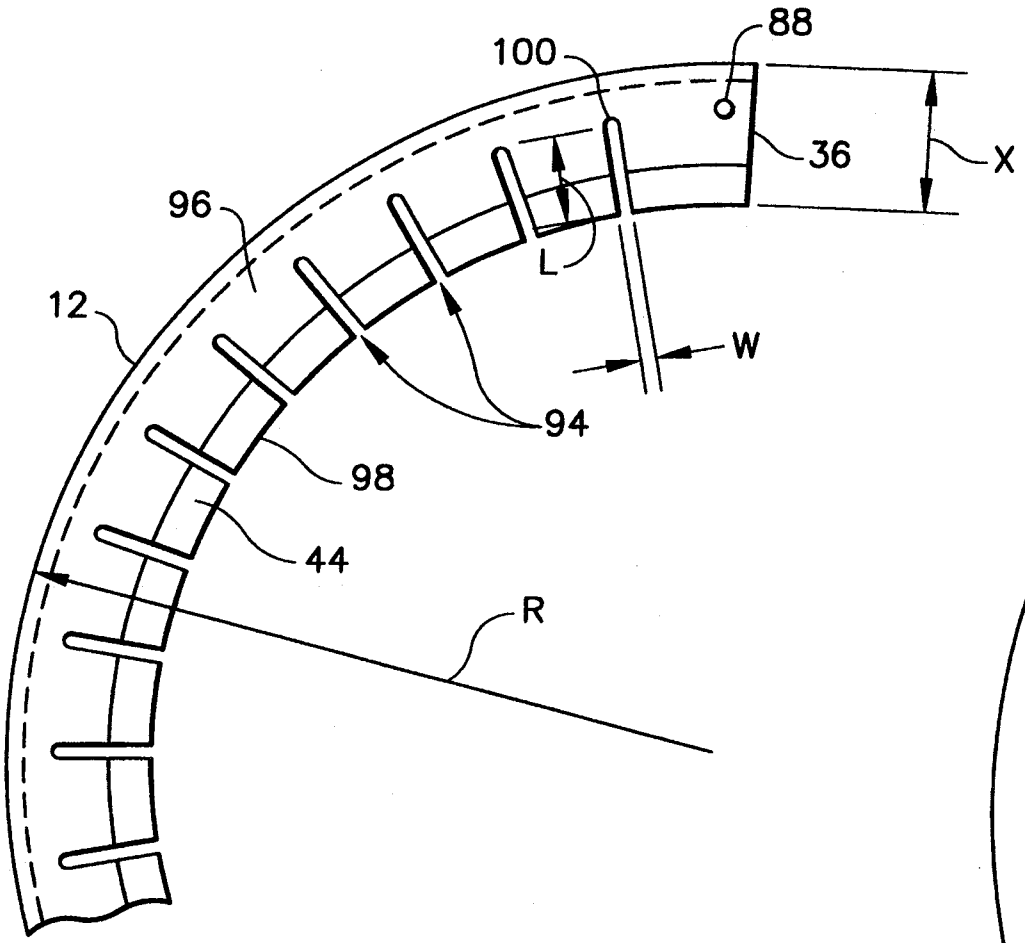
FIG. 3 is a schematic, plan view of a sector portion of an annular die cavity body advantageously utilized in the present invention.

For the apparatus 10 to produce uniform, continuous, arcuate contour bends in a tube 20, the die cavity body 12 must be sufficiently compliant to modify its radius of curvature R in cooperation with the arbor 14; however, it must also be stiff enough to provide adequate support of radial and axial loads induced by the tube 20 and follower 16 in the forming zone 18. Referring now to FIGS. 3 and 6, shown is a schematic, plan view of a sector portion of die cavity body 12 and an enlarged sectional view, respectively. The die 12 is of substantially constant cross-section and has generally uniform features therearound. Proximate first end 36 of the die 12 is an axially oriented pin 88 retained in the die body 12, for example, by an interference fit. The pin 88 extends through the die cavity lower face 90 and is disposed in a radially oriented slot 92 in the toothed ring 50, shown in FIG. 5. The slot 92 allows radial movement of the die 12 with respect to the ring 50 during actuation of the adjustment feature 54 while providing positive retention of the die 12 in the circumferential direction during tube bending. Except for the first end 36, the die body 12 is unrestrained in the circumferential direction, so that the die 12 can closely cooperate with the arbor 14 throughout the adjustment range.

In order to provide the requisite flexibility in the die body 12 so that it may readily conform to the arbor 14 throughout the adjustment range, a plurality of substantially similar kerfs 94 extend from the lower face 90 to the parallel upper face 96, and from the inner wall 98 radially outwardly. In the free state, each kerf 94 has a substantially uniform width, H, radial length, L, and smooth, contoured end portion 100 to minimize any stress concentration associated therewith. Further, the free stats size of the die 12 and arbor 14 are predetermined so that at the minimum desired radius of curvature of the die body 12, there is full engagement of respective frustoconical contours 44, 42. In other words, the minimum diameter of the frustoconical contour 42 of the arbor 14 is substantially equivalent to the free state minimum diameter of the frustoconical contour 44 of the die 12 at inner wall 98. Actuation of the adjustment means 54 to increase the radius of curvature R increases the width W of the kerfs 94 substantially uniformly to achieve the desired result.

The suitability of the die 12 for a particular purpose is a function of a number of variables related to toughness and flexibility including, inter alia, die cavity material and height, H; kerf width W, length L and number; and adjustment range desired. Clearly, a die body 12 comprised of a very stiff material with e large number of narrow width, long kerfs 94 may be desirable for a tube bending application entailing high forming loads, where the requisite range of adjustment of radius of curvature R is small. Where tougher, more resilient materials are employed, fewer kerfs 94 of the same dimension may be employed to achieve the same range of adjustment or a greater number of the same or differing dimension kerfs 94 may be employed to achieve greater range of adjustment. In the extreme, where the kerfs 94 are too narrow, too short and/or too few in number for the desired range of adjustment, the die body 12 could crack and fail during adjustment or use.

Figure 4:
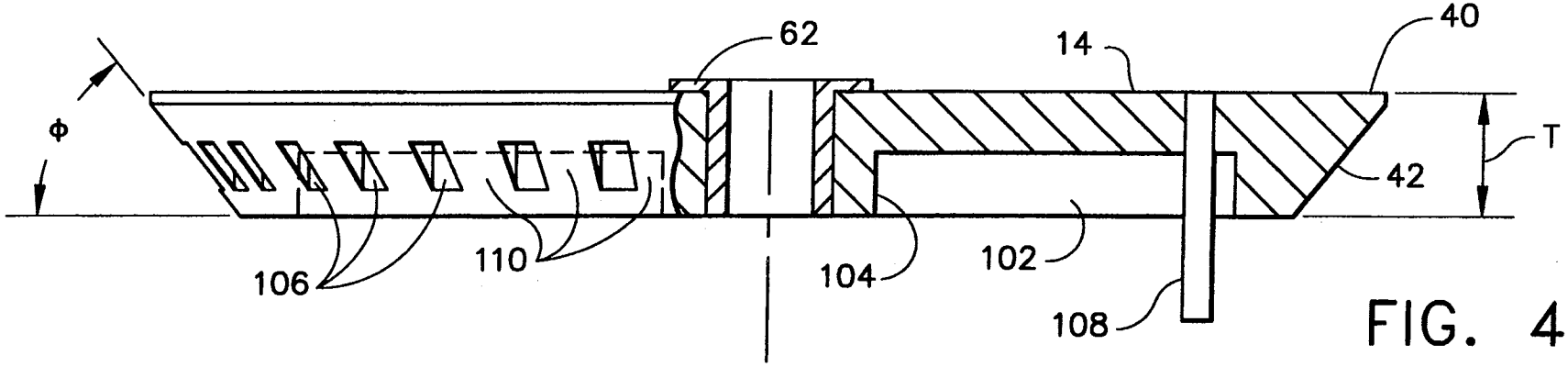
FIG. 4 is a schematic, longitudinal, partially sectional view of an arbor member utilized with the present invention.
Figure 5:
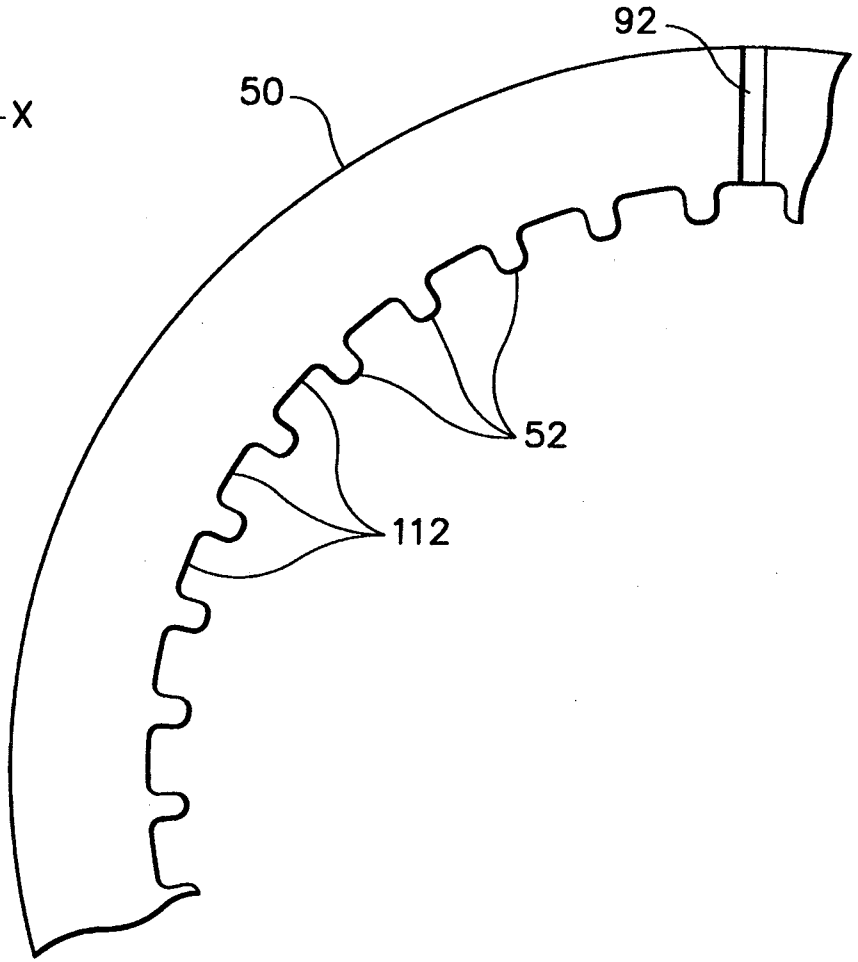
FIG. 5 is a schematic, plan view of a sector portion of a die support structure utilized with the present invention.
Figure 6:
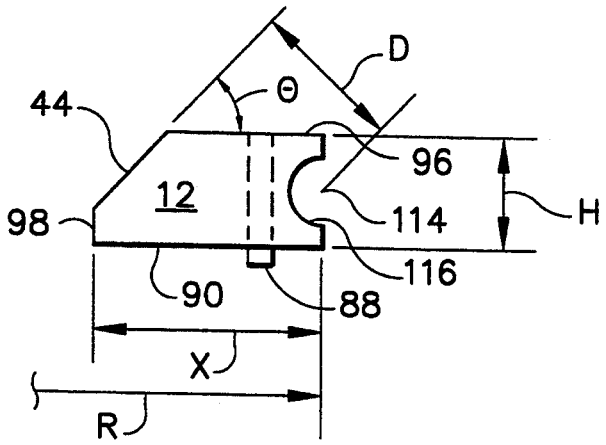
FIG. 6 is a schematic, enlarged sectional view of an annular die cavity body advantageously utilized in the present invention.

Shown in FIGS. 4 and 5, respectively, are the arbor 14 and toothed ring 50 which cooperate to radially and axially support the die 12. The arbor 14 is conventionally manufactured from metal or any rigid material suitable for withstanding the forming loads. The frustoconical contour 42 has an included angle phi, $\phi$, which may generally be selected in the range of thirty to sixty degrees. The mating contour 44 of the die 12 has a mating angle theta, 0, as shown in FIG. 6. To provide full contact area between respective contours 44, 42, phi and theta are conventionally equivalent. Obviously, the greater the value of theta and phi, the less sensitive the radius of curvature of the die cavity 12 will be to changes in axial height of the arbor 14. The thickness T of the arbor rim 40 is determined in concert with the included angle $\phi$ and die height H to produce a contour 42 of sufficient magnitude to support the die 12 throughout the desired range of adjustment. The arbor 14 may be machined from a single plate of aluminum, for example, or may be a fabrication. In the arbor 14 shown, annular pocket 102 is provided between rim 40 and hub portion 104 to reduce weight. Alternatively, a spoked configuration could be employed.

A plurality of shaped apertures 106 are disposed in the rim 40, equiangularly spaced along contour 42. Circumferential registration of these apertures 106 with the protrusions 52 of toothed ring 50 is ensured by alignment pin 108, which may be retained in arbor 14 by an interference fit and axially slidingly engaged in a mating hole (not shown) in arm 24 upon which toothed ring 50 and spacer ring 48 are mounted. In this manner, axial adjustment of the arbor 14 is afforded while maintaining circumferential registration of all elements. The protrusions 52 are incorporated to provide support to the radially innermost portion of the die cavity 12 when the arbor 14 is raised to provided a minimum radius of curvature. Failure to support the die 12 in this condition could result in twisting of the die 12 out of the bending plane during the forming operation. As the arbor 14 is adjusted to increase the radius of curvature R and the die 12 migrates radially outwardly, the cooperation of the protrusions 52 and apertures 106 afford unrestricted movement of the arbor 14 into the plane of the toothed ring 50. As the protrusions 52 mesh with the apertures 106, the ribs 110 formed between apertures 52 pass unrestrictedly into gaps 112 in the ring 50. The size, number and orientation of the protrusions 52 apertures 106, ribs 110 and gaps 112 are predetermined to provide adequate support to the die 12 throughout the range of adjustment desired. Further, angular orientation of die pin 88, toothed ring slot 92, protrusions 52 and kerfs 94 are predetermined to ensure, to the extent possible, that at minimum radius adjustment conditions when the die 12 is supported by the protrusions 52, that the protrusions 52 do not align with the kerfs 94. In the event this alignment condition exists, the protrusions 52 are maintained wider than the kerfs 94 so that the kerf width W is straddled and the die 12 effectively supported.

In an exemplary embodiment of the apparatus 10 for bending a particular 0.5 inch nominal diameter steel tube having a given wall thickness and nominal material properties, it has been determined that to achieve a desired free state radius of curvature of 15.000 $\pm$0.030 inches, the tube may be bent in a conventional die cavity having a nominal radius R of 12.625 inches. The die body 12 is machined from a one inch thick sheet of commercially available Delrin resin, which is a registered trademark of E.I. DuPont de Nemours, Inc. for a homopolymer polyformaldehyde acetyl resin, to a nominal free state radius of 12 inches at the tube cavity center 114 to allow sufficient range for adjustment about the nominal value of 12.625 inches. A plurality of 0.25 inch wide, 1.6 inch long kerfs 94 are disposed in the die 12 at equivalent spacing of 10 degrees. The contoured end portion 100 of each kerf has a 0.125 inch radius, to facilitate manufacture of the kerf width and end 100 in a single pass of a 0.125 inch radius milling cutter. Penetration of the kerf 94 in the radial direction is approximately 67% of the radial length X of the annular die 12, which in this case is approximately 2.4 inches. The frustoconical contour 44 has an angular value theta of fifty degrees with respect to radial to match the fifty degree angle phi of the contour 42 of the arbor 14. The tube cavity 116 is precisely machined in semicircular contour to fully support the tube and prevent any surface discontinuities. Further, distance D between the tube cavity center 114 and contour 44 is tightly controlled to ensure a constant, uniform bend radius R.

The die 12 is used in cooperation with an arbor 14 having a rim thickness T of approximately 2.25 inches, resulting in a radius of curvature adjustment range between a minimum value of about 12.00 inches, corresponding with the free state dimension of the die 12, and a maximum value of about 13.25 inches. Based on experience, it has been determined that the magnitude of the characteristic elastic springback is substantially constant for all of the tubes processed by a manufacturer in a given heat treat lot. That is to say that while springback magnitude may vary between one heat treat lot of tubes to the next, requiring a different radius of curvature R of apparatus 10 to achieve the desired free state tube contour, all tubes within a given heat treat lot may typically be bent at a fixed radius of curvature R once the proper adjustment to the apparatus 10 has been achieved. In practice, fine adjustment of radius of curvature is typically approached in decreasing magnitude, from an oversize radius condition.

The die material, sizes and features presented as an exemplary embodiment of a representative case are by no means exhaustive of the various configurations contemplated within the scope of the invention. As stated hereinabove, other commercially available die materials have been utilized with success, including Teflon TFE, which is a registered trademark of E.I. DuPont de Nemours, Inc. for a type of fluorocarbon resin, and nylon, from the group of polyamide resins. Desirable characteristics include, inter alia, toughness, elasticity and strength combined with resistance to wear. These materials are also readily machinable to the desired contour and available in the required sheet stock size.

Figure 8:
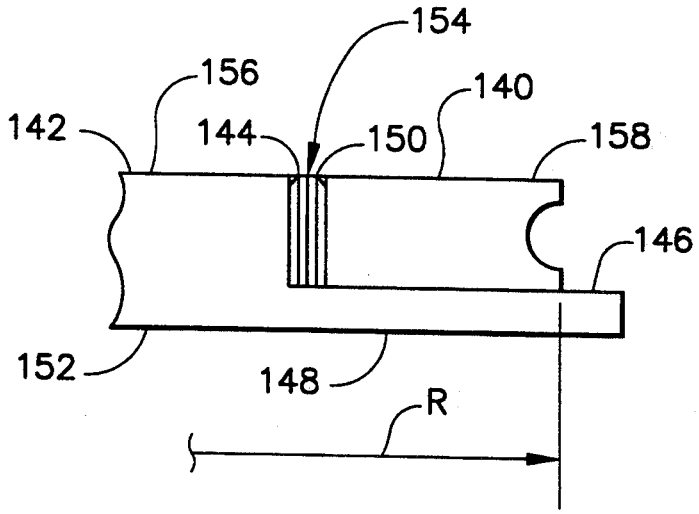
FIG. 8 is a schematic, sectional view of a portion of the tube bending apparatus depicted in FIG. 1 according to another alternate embodiment of the present invention.
Figure 7:
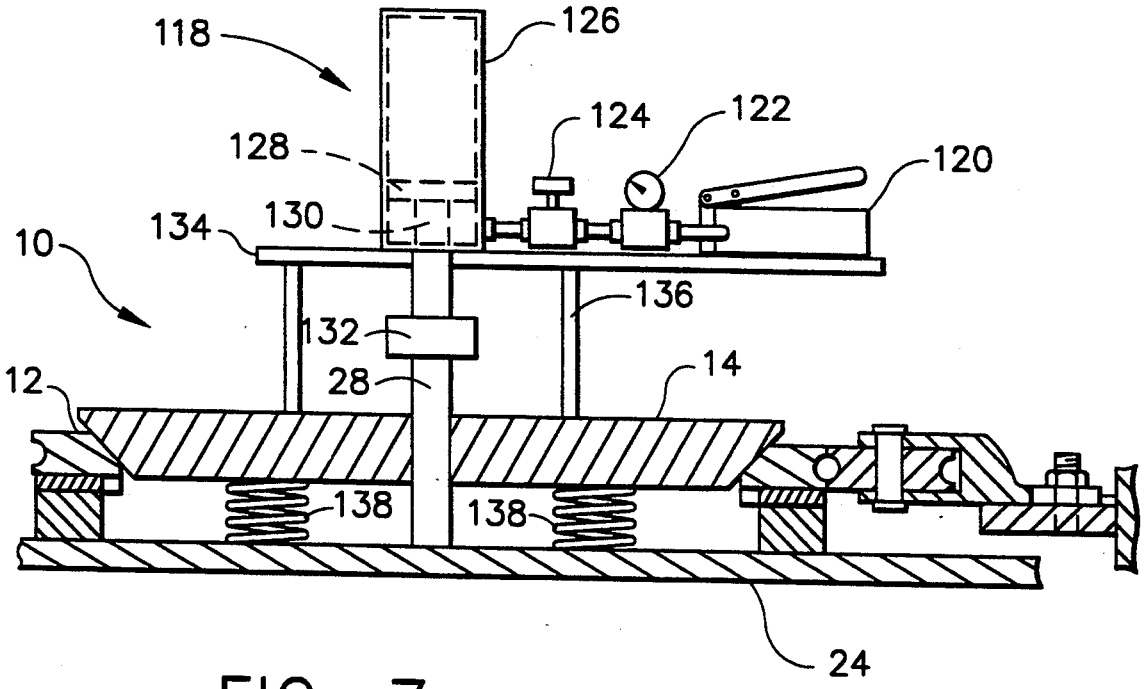
FIG. 7 is a schematic, longitudinal view of a portion of the tube bending apparatus depicted in FIG. 1 according to an alternate embodiment of the present invention.

Other variations and alternate embodiment are also envisioned such as those depicted in FIGS. 7 and 8. For example, the mechanical adjustment feature 54 shown in FIG. 2 may be replaced by a hydraulic adjustment means 118 shown in FIG. 7, comprising an hydraulic pamp 120, pressure indicator 122, valve 124 and hydraulic cylinder 126. Piston 128 is operatively connected via shaft 130 through coupling 132 to shaft 28 of the tube bending apparatus 10. Cylinder 126 is disposed on a plate 134 which is separated from the arbor 14 by a cylindrical support 136. Pressurization of the cylinder 126 causes translation of the cylinder 126, plate 134, support 136 and arbor 14 downward as depicted in the figure, forcing the die 12 radially outwardly. The arbor 14 is shown supported, in a preferred embodiment in this depiction, by a plurality of springs 138 located between arbor 14 and arm 24 at a common radius. Adjustment may be made by pressurizing the cylinder 126 to compress the springs 138, then slowly bleeding fluid from the cylinder 126 through the valve 124. Once the proper arbor location has been achieved closure of the valve 124 effectively locks the arbor 14 in place. Jacking screws 68 shown in FIG. 2 could be incorporated to provide additional support. All other elements of apparatus 10 are similar to the FIG. 2 depiction.

FIG. 8 shows an alternate means for supporting a different expandable die cavity body 140 on an alternate rigid arbor member 142 which obviates the need for the mechanical adjustment feature 54 or hydraulic adjustment means 118. The arbor 142 is comprised of a cylindrical plate 152 with a cylindrical outer wall 144 having a radial support surface 146 extending from a lower face 148 of the arbor 142 upon which die 140 is disposed. Die 140 is generally similar in structure and features to die 12 with the exception that the inner diameter is comprised of a orthogonal wall 150 instead of a frustoconical contour 44. At a minimum radius condition of die 140, wall 150 is disposed in intimate contact with arbor outer wall 144. Adjustment of radius of curvature R is achieved by means of disposing between wall 144 and wall 150 a continuous band 154 which may be sequentially wrapped around arbor 142 in a plurality of layers. Clearly with each wrap layer, the effective radius of the arbor 142 is increased, thereby increasing the radius of curvature R of the die 140. Surface 146 provides support to both the die 140 and the band 154 and should extend radially outwardly a sufficient distance to provide full support to the die throughout the desired range of adjustment. The band 154may be stored in a planar coil (not shown) concentric with an axis of rotation of the arbor 142 to facilitate wrap layer adjustment. If warranted, a second radially extending structure, similar to support 146 may be employed proximate upper faces 156, 158 to prevent out-of-plane motion during the bending operation.

While there have been described herein what are considered to be preferred embodiments of the present invention, other modifications of the invention will be apparent to those skilled in the art from the teachings herein, and it is therefore desired to be secured in the appended claims all such modifications as fall within the true spirit and scope of the invention. Accordingly, what is desired to be secured by Letters Patent of the United States is the invention as defined and differentiated in the following claims:

I claim:

1. A tube bending apparatus comprising:

a first arcuate die cavity body having a first continuous external surface along at least a portion of a circumference thereof, said first surface having a first radius of curvature;

a second arcuate die cavity follower having a second external surface along at least a portion of a circumference thereof coplanar with said first external surface and converging with said first external surface at a common tangency producing a tube forming zone therebetween;

clamp means for clamping a portion of a tube in a fixed location relative to said first die cavity body;

draw means for drawing said tube through said forming zone while wrapping said tube around said first external surface of said portion of said circumference of said first die cavity body; and adjustment means for changing said radius of curvature of said first die cavity body.

2. The invention according to claim 1 wherein said adjustment means comprises:

a rigid arbor member, said member having a generally frustoconical external contour, circumscribed along at least a portion thereof by said first die cavity body, said body further comprising a resilient annulus, having a mating frustoconical internal contour;

actuating means for modifying relative registration of said respective frustoconical contours; and locking means for maintaining fixed registration between said respective frustoconical contours.

3. The invention according to claim 2 wherein:

said frustoconical internal contour of said resilient annulus further comprises a plurality of kerfs extending from a lower face of said annulus to an upper face of said annulus and from an inner wall of said annulus through a limited radial portion thereof.

4. The invention according to claim 3 further comprising:

a support structure to support said resilient annulus, said support structure comprising a rigid, annular ring having a plurality of radially inwardly extending protrusions oriented for disposition in a common number of slots in said external contour of said arbor during registration translation of said arbor, said slots sized to permit unrestricted registration adjustment of said arbor with respect to said resilient annulus.

5. The invention according to claim 4 further comprising:

clamp adjustment means to adjust location of said clamp means in cooperation with said first die cavity body.

6. The invention according to claim 5 wherein:

said draw means comprises a radially extending arm on which said clamp means is adjustably disposed.

7. The invention according to claim 2 wherein:

said actuating means comprises a cylinder actuated by a pressurized fluidic reservoir of a fluidic system and a spring reacting a load applied by said cylinder; and said locking means comprises a valve in combination with said reservoir of said fluidic system.

8. The invention according to claim 2 wherein:

said actuating means comprises a threaded mechanical assembly and a spring reacting a load applied by said assembly; and said locking means comprises said threaded mechanical assembly.

9. The invention according to claim 2 further comprising:

follower adjustment means to adjust location of said second arcuate die cavity follower in cooperation with said first arcuate die cavity body to maintain said common tangency and said tube forming zone therebetween.

10. The invention according to claim 1 wherein:

said adjustment means comprises a rigid arbor member, said member having a generally flat external contour with one or more radially extending edges to guidingly receive thereagainst a predetermined length of a continuous band for adjusting a cumulative outer diameter thereof; and further receiving thereagainst, along at least a portion thereof, said first die cavity body, said body further comprising a resilient annulus having a mating, substantially flat internal contour and a plurality of kerfs extending from a lower face of said annulus to an upper face of said annulus and from said internal contour of said annulus through a limited radial portion thereof.

* * * * *